US007597587B1

(12) United States Patent
Duesterhoeft

(10) Patent No.: US 7,597,587 B1
(45) Date of Patent: Oct. 6, 2009

(54) MOUNTABLE CONNECTOR ASSEMBLIES AND FRAMES

(75) Inventor: Scott Stephen Duesterhoeft, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/107,550

(22) Filed: Apr. 22, 2008

(51) Int. Cl.
*H01R 13/73* (2006.01)

(52) U.S. Cl. ..... 439/545

(58) Field of Classification Search ..... 439/545, 439/465, 247–248, 557, 552–554, 157, 544, 439/310, 372, 347, 567, 562
See application file for complete search history.

(56) References Cited

U.S. PATENT DOCUMENTS 5,127,852 A * 7/1992 Cravens et al. ..... 439/545
5,800,208 A * 9/1998 Ishizuka et al. ..... 439/557
6,030,242 A 2/2000 Cunningham et al.
6,095,854 A 8/2000 Sommer et al.
6,176,738 B1 1/2001 Consoli et al.
6,312,285 B1 11/2001 Berg et al.
6,332,789 B1 * 12/2001 Okabe ..... 439/157
7,137,847 B2 11/2006 Trout et al.
7,168,978 B1 1/2007 Trout et al.

* cited by examiner

*Primary Examiner*—Edwin A. Leon

(57) ABSTRACT

An electrical connector assembly for mounting to a panel. The panel includes a latch element that projects outward from a first side of the panel. The connector assembly includes a connector body that has a mating end configured to interface with the panel and mate with another electrical connector through the cut-out. The connector assembly also includes at least one tab extending away from the body. The tab is oriented to engage a second side of the panel. Also, the connector assembly includes a wing member that extends away from the body and is oriented to move along the first side when moved in a locking direction. The wing member includes an end portion and a latch opening. The wing member is configured to flex away from the first side and resile toward the first side and engage the latch element.

20 Claims, 6 Drawing Sheets

MOUNTABLE CONNECTOR ASSEMBLIES AND FRAMES

BACKGROUND OF THE INVENTION

The subject matter herein relates generally to electrical connectors and more particularly to electrical connectors mounted to a panel of an electrical device or system.

Some electrical systems and devices today are designed to include ports along the panels or walls of an electrical system or device, such as a portable computer. The ports may allow an operator of the system to establish a communication or transmission line to a peripheral device (e.g., an RF antenna). In addition, the ports may allow the operator to establish a power connection for the system or the peripheral device. The ports generally include a receptacle that holds contacts configured to mate with an electrical connector coupled to the peripheral device. The receptacle is typically mounted to either the front or back side of the panel using hardware, such as screws, clips, pins, and the like. However, using hardware may increase the amount of time and cost used to construct the system. But if hardware is not used to attach the receptacle to the panel, the receptacle may inadvertently disengage from the panel during normal use of the system.

In some known connector assemblies, a receptacle body is mounted to a panel having a cut-out. The receptacle body includes an arm that extends parallel to and alongside an interior surface of the panel. The arm has a projection that extends toward the interior surface. In order to mount the receptacle body to the panel, a portion of the receptacle body is inserted through the cut-out. As the portion extends therethrough, the arm projection engages the interior surface of the panel causing the arm to flex backward. The receptacle body is then moved in a lateral direction alongside the panel such that the arm projection drags along the interior surface. When the arm projection clears an edge of the cut-out, the arm projection snaps into a locked position. As such, both a portion of the receptacle body and the arm projection extend through the cut-out. However, because the projection is exposed to a surrounding exterior, the projection may be inadvertently triggered causing the receptacle body to disengage from the panel. In addition, because the arm projection engages the interior surface before the receptacle body is moved laterally the stored energy within the arm may make mounting the receptacle body more difficult.

Thus, there is a need for an electrical connector assembly that may be mounted to a panel without using hardware. There is a need for an electrical connector assembly that may be mounted to a panel with a reduced risk of being inadvertently disengaged. There is a need for an electrical connector assembly that may be easier for a user to mount to a panel than the known mountable connector assemblies described above.

BRIEF DESCRIPTION OF THE INVENTION

In one embodiment, an electrical connector assembly for mounting to a panel is provided. The panel includes a cut-out and a latch element that projects outward from a first side of the panel. The connector assembly is configured to move alongside the panel in a locking direction from an inserted position to a locked position. The connector assembly includes a connector body that has a mating end configured to interface with the panel and mate with another electrical connector through the cut-out. The connector assembly also includes at least one tab that extends away from the body. The tab is oriented to engage a second side of the panel when in the locked position. Also, the connector assembly includes a wing member that extends away from the body and is oriented to move along the first side when moved in the locking direction. The wing member includes an end portion and a latch opening that is configured to receive the latch element. The wing member is configured to flex away from the first side when the end portion engages the latch element and resile toward the first side when the latch opening receives the latch element.

Optionally, the end portion may include a lip that projects at a non-orthogonal angle away from the first side. The lip may be configured to engage the latch element when the wing member is moved in the locking direction. Also, the tab may be positioned forward of the wing member such that when the connector body is in the inserted position the wing member is engaged with the first side and the tab has cleared the second side. Also optionally the connector assembly may include a frame that surrounds and holds the connector body. The tab and the wing member may be coupled to and extend from the frame. In addition, the wing member may include a planar section that extends from the body to the end portion. The planar section may include the latch opening and be oriented to abut the first side when in the locked position.

In another embodiment, a frame for holding an electrical connector body is provided. The frame is configured to mount a panel having a cut-out and a latch element projecting outward from a first side of the panel. The frame is also configured to move along the panel in a locking direction from an inserted position to a locked position. The frame includes a mating end that is configured to interface with the panel when mounted thereto and at least one tab that extends away from the mating end. The tab is oriented to engage a second side of the panel when in the locked position. The frame also includes a wing member that extends away from the mating end and is oriented to slide along the first side when moved in the locking direction. The wing member includes an end portion and a latch opening that is configured to receive the latch element. The wing member is configured to flex away from the first side when the end portion engages the latch element and resile toward the first side when the latch opening receives the latch element.

Optionally, the frame is stamped and formed from sheet metal. Also, the mating end of the frame may include a front edge. The tab and the wing member may be coupled to and extend from the front edge.

DETAILED DESCRIPTION OF THE INVENTION

Figure 1:
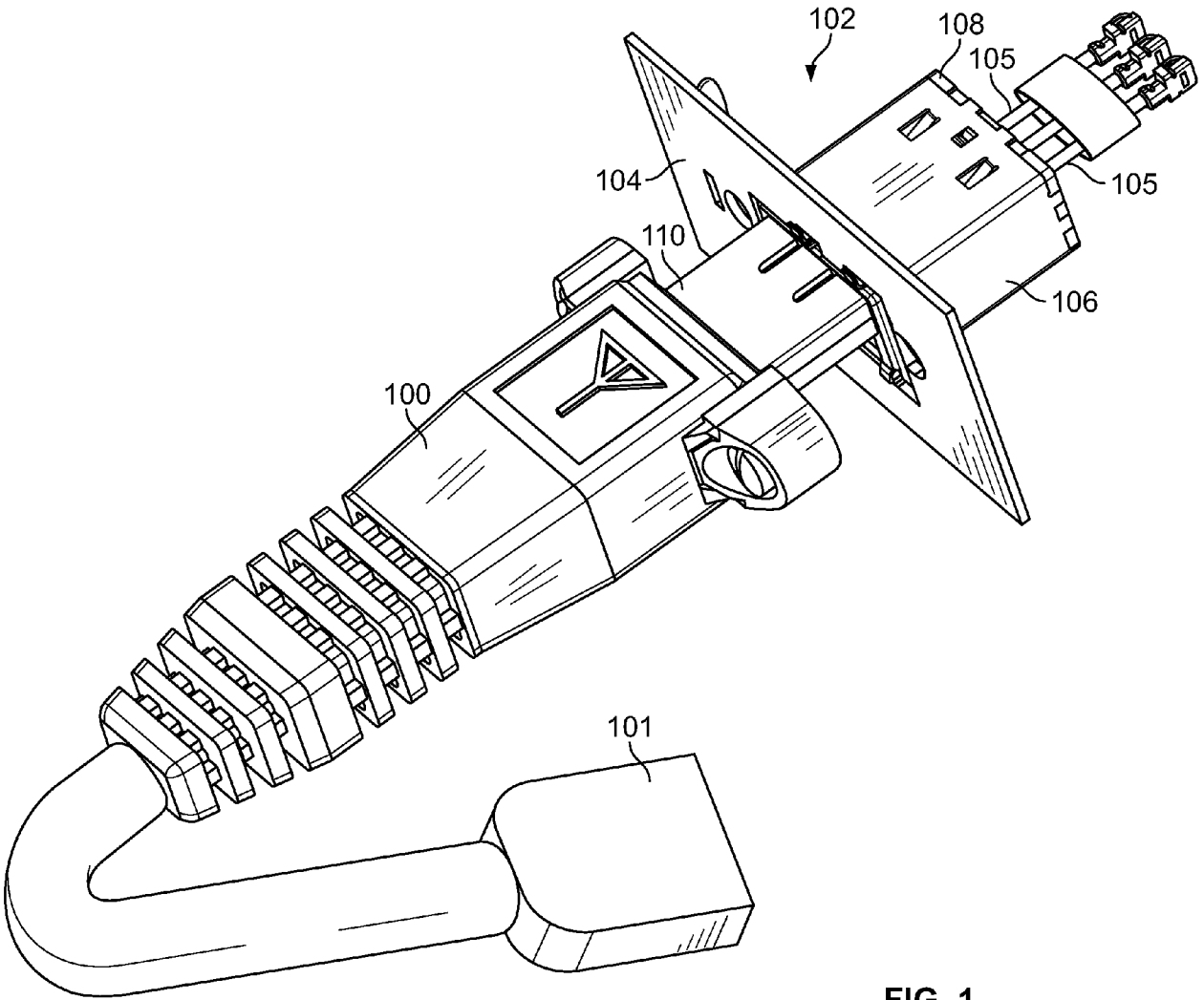
FIG. 1 is a front perspective view of a cable module engaging an electrical connector assembly formed in accordance with one embodiment.

FIG. 1 is a front perspective view of a cable module 100 as the module 100 engages an electrical connector assembly 102 formed in accordance with one embodiment. The connector assembly 102 is mounted to a panel 104 and is in electrical communication with a host system or device via transmission/power lines 105. The host system may be, for example, a portable computer. The connector assembly 102 may include a shield or frame 106 that is formed or shaped to surround a connector body 108. The panel 104 at least partially separates an interior of the system, which houses a majority of the frame 106 and the connector body 108, with an exterior of the system where the module 100 is located. As shown, the connector assembly 102 is in a locked position with respect to the panel 104.

The module 100 is configured to engage and mate with the connector body 108. The module 100 is in electrical communication with another system or device, such as an RF antenna 101. The module 100 may include a plug body 110 that is configured to mate with a cavity 124 (shown in FIG. 2) of the connector body 108. The plug body 110 may include plug contacts (not shown) that are configured to engage with corresponding mating contacts (not shown) within the cavity 124. In the exemplary embodiment, the module 100 is a multi-port QSL type connector developed by Tyco Electronics Corporation and the connector body 108 is a receptacle configured to receive and electrically couple with the module 100. However, the connector body 108 and the module 100 may be any type of electrical connector including an electro-optical connector. For example, the connector body 108 may include a plug that projects outward through the panel 104 and the module 100 may include a receptacle or cavity that is configured to receive the plug. As such, the illustrated embodiment is not intended to be limiting and the connector assembly 102 may be any type of electrical connector capable of being mounted to the panel 104 and the module 100 may be any type of electrical connector capable of mating with the connector assembly 102.

Figure 2:
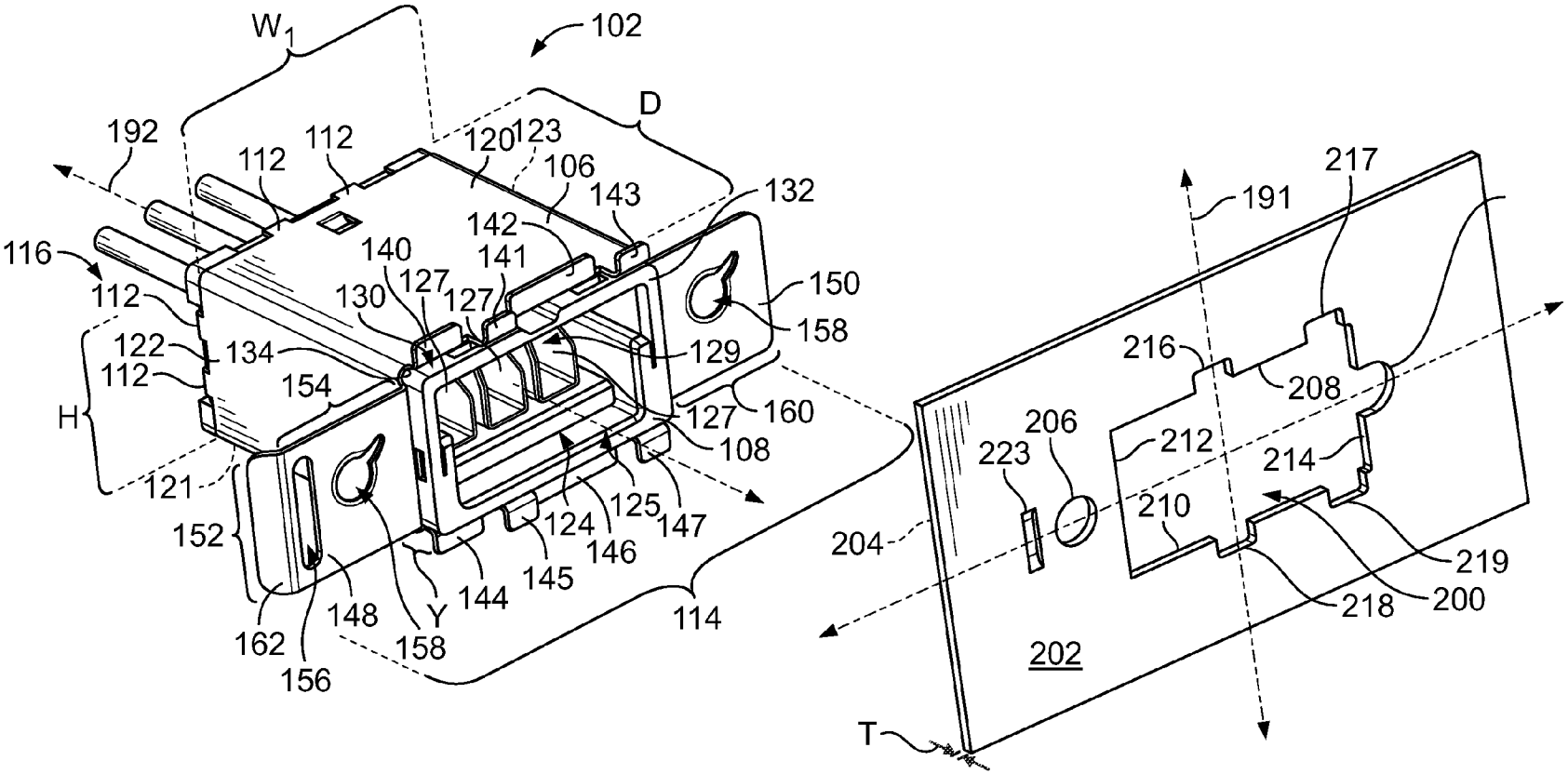
FIG. 2 is a front perspective view of the connector assembly shown in FIG. 1 before the connector assembly is mounted to a panel.

FIG. 2 is a front perspective view of the connector assembly 102 before the connector assembly 102 engages the panel 104. The connector assembly 102 extends along a longitudinal central axis 192 and include a mating end 114 and a loading end 116. As will be discussed in greater detail below, the connector assembly 102 is configured to be moved in a forward or mating direction along the central axis 192 and inserted through a cut-out 200 of the panel 104 into an inserted position (shown in FIGS. 3 and 4). The connector assembly 102 may then be moved in a locking direction, such as along the lateral axis 190, from the inserted position into the locked position (shown in FIGS. 1 and 6). In the locked position, the connector assembly 102 is engaged with a latch element 222 (shown in FIG. 4) of the panel 104. As such, the connector assembly 102 may provide a slide-and-lock type mounting mechanism.

In the illustrated embodiment, the connector assembly 102 includes the frame 106 and the connector body 108, which has an opening 125 leading into the cavity 124. The cavity 124 may include one or more mating ports 127 having mating contacts (not shown) configured to engage the plug contacts of the plug body 110 (FIG. 1) when the module 100 is mated with the connector assembly 102. For example, each mating port 127 may include a port opening 129 for receiving one or more plug contacts. Optionally the cavity 124 may be keyed and/or include guidance features for directing the plug body 110 so that the corresponding plug contacts properly engage the mating contacts. As shown, the mating ports 127 are arranged in a row, however, other configurations may be provided in alternative embodiments, such as multiple rows stacked upon each other. Furthermore, the connector body 108 is not required to include the mating ports 127, but may include other ways of engaging the plug contacts of the module 100 with the mating contacts of the connector body 108.

In an alternative embodiment, rather than the connector body 108 having one cavity 124 with the plurality of mating ports 127, the connector assembly 102 may include a plurality of separate connector bodies held within the frame 106. Each separate connector body may include one or more cavities for holding the mating contacts.

Also shown in FIG. 2, the frame 106 and the connector body 108 may be separate components that are formed and shaped to couple with one another. For example, the frame 106 may be stamped and formed from sheet metal and the connector body 108 may be formed from plastic or some other insulative material during an injection molding process. The connector body 108 may then be inserted into the frame 106, which may include extensions or latches 112 that grip the connector body 108 near the loading end 116 and hold the connector body 108 within the frame 106. However, in alternative embodiments, the connector assembly 102 is integrally formed to include the features of the frame 106 and the connector body 108 as will be described below. For example, the connector assembly 102 may be entirely made of a dielectric material that may be mounted to the panel 104 as described herein. Furthermore, the frame 106 and the connector body 108 may be formed from similar materials. In alternative embodiments in which the connector assembly 102 is fabricated from metal material(s), one or more dielectric inserts may be provided within the cavity 124 to electrically isolate the connector assembly 102 from the plug contacts. Accordingly the following discussion of the features of the frame 106 may similarly be applied to the connector assembly 102 generally or, more specifically to the connector body 108.

In the illustrated embodiment the connector assembly 102 has a substantially rectangular cross-sectional shape and is formed from a plurality of sides 120-123. More specifically the connector assembly includes opposing top and bottom sides 120 and 121, respectively that extend widthwise and parallel to a lateral axis 190 and opposing sides 122 and 123 that extend parallel to another lateral axis 191. In an exemplary embodiment, the lateral axis 190 may define a horizontal axis and the lateral axis 191 may define a vertical axis. The sides 120-123 may extend parallel with respect to each other and form a passage (not shown) therebetween for holding the connector body 108. The sides 120-123 may extend a depth D from the mating end 114 to the loading end 116. Further, the opposing sides 120 and 121 may extend a width $W_1$ of the connector assembly 102, and the opposing sides 122 and 123 may extend a height H. Alternatively, the connector assembly 102 may be formed to have other cross-sectional shapes, such as a circle, an octagon, a semi-circle, and the like.

While the illustrated embodiment is designed for horizontal mounting to the panel 104 with the side 120 generally upward facing and the side 121 generally downward facing, it is realized that alternative mounting orientations are possible, such as vertical mounting or mounting up-side down. As such, the terms top, bottom upper, lower, upward, downward and the like are relative and based on the orientation of the illustrated embodiment, and are not intended to be restrictive. For example, if the connector assembly 102 were mounted upside down the side 120 may be positioned generally vertically below the side 121. Additionally terms such as forward facing or extending forward generally refer to a direction toward the exterior of the host system and terms such as rearward facing or extending rearward generally refer to a direction toward the interior of the electrical system. Likewise, although the exemplary embodiment illustrates a rear-mounting type mechanism such that the connector assembly 102 is substantially within the interior of the system the connector assembly 102 may also be mounted on a front side 202 of the panel 104 such that the connector assembly 102 is substantially in the exterior of the system.

As will be described in further detail, the mating end 114 is configured to engage and interface with the panel 104 along an interface plane that is formed by the horizontal and vertical axes 190 and 191. When properly mounted and aligned with the panel 104, the mating end 114 allows access to the cavity 124. In some embodiments, the mating end 114 includes a front end 130 of the connector body 108. The front end 130 may include a forward-facing portion 132 that defines a perimeter of the opening 125. When mounted to the panel 104, the front end 130 may project forward through the cut-out 200 into the exterior of the system. Alternatively the front end 130 may be flush with the mating end 114 of the frame 106 or be configured to reside within the cavity 124 such that the frame 106 of the mating end 114 of the frame 106 extends beyond the front end 130 of the connector body 108.

The mating end 114 may also include parts and features of the frame 106. More specifically the frame 106 may include a front edge 134 that extends around the connector body 108 proximate to the forward-facing portion 132 of the connector body 108. In the exemplary embodiment the front edge 134 is located a distance Y behind the forward-facing portion 132 of the connector body 108. The connector assembly 102 also includes a plurality of tabs 140-147 and a pair of wing members 148 and 150 that extend away from the connector body 108. In the exemplary embodiment the tabs 140-147 and the wing members 148 and 150 are coupled to and extend away from the front edge 134. However, in other embodiments, the tabs 140-147 and wing members 148 and 150 are coupled to and extend away from the sides 120-123. The distance Y may be substantially equal to a thickness T of the panel 104 or a distance X (shown in FIG. 6).

Figure 4:
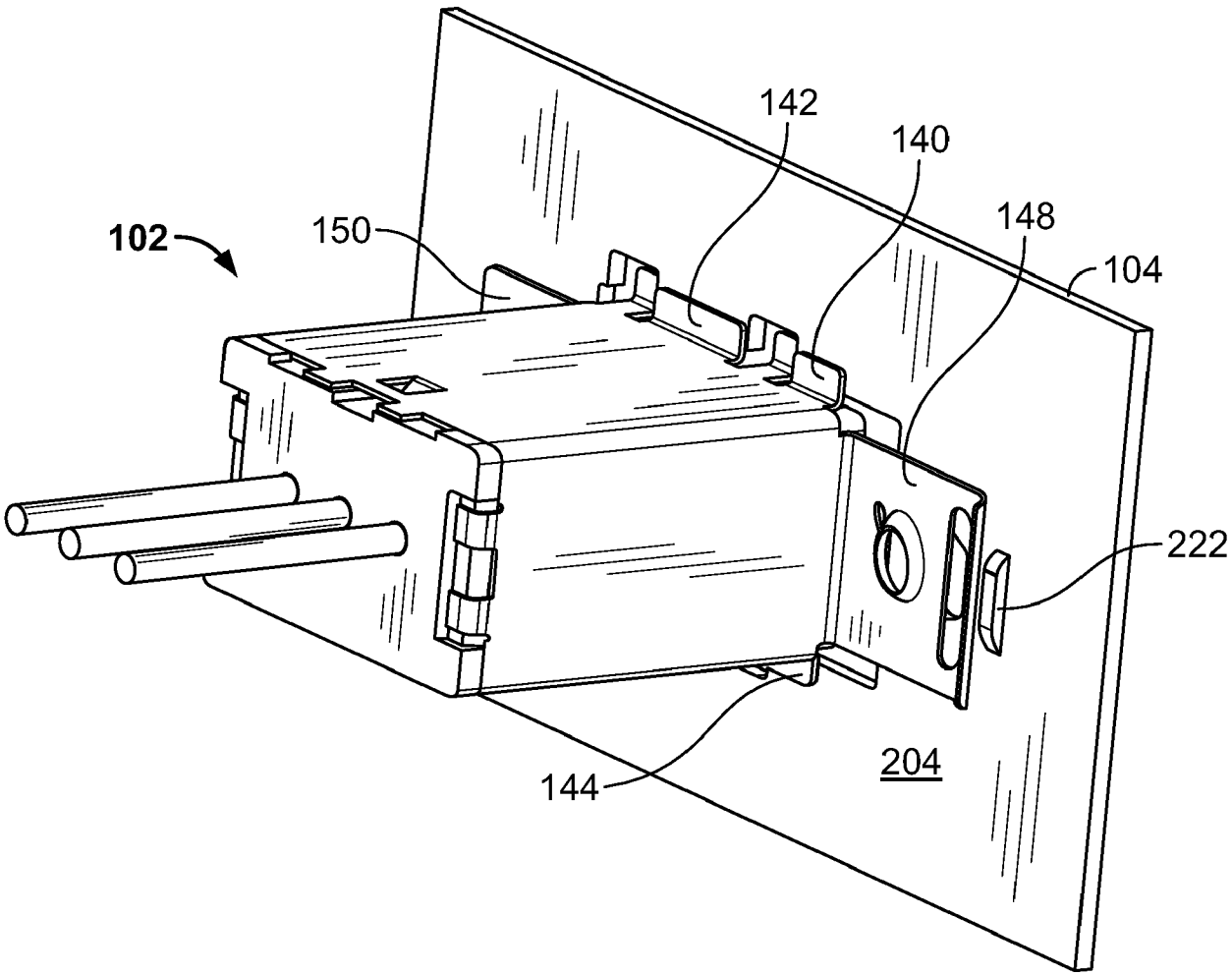
FIG. 4 is a rear perspective view of the connector assembly and the panel shown in FIG. 3.

As shown, the wing members 148 and 150 may extend away from each other in opposing directions. The wing member 148 includes an end portion 152 and a planar section 154 that extends from the front edge 134 to the end portion 152. The planar section 154 includes a latch opening 156 that has a shape configured to receive and engage the latch element 222 (FIG. 4). In the exemplary embodiment, the latch element 222 is a projection formed from an indentation 223 of the panel 104. The latch element 222 may be rounded or may have edges that project from the panel 104 as shown in FIG. 4. Alternatively, the latch element 222 may be a separate component that is coupled to the panel 104 such as a post or hook. As shown in FIG. 2, the latch opening 156 may be a cut-out or, alternatively, the latch opening 156 may lead into a cavity that, for example, is formed from an indentation of the planar section 154. The wing member 150 may include a planar section 160. In the exemplary embodiment, the latch opening 156 has an elongated shape that extends in a direction that is substantially perpendicular to the locking direction. More specifically the latch opening 156 may extend a substantial width of the wing member 148 (or the height of the frame 106). In embodiments in which the latch opening 156 has an elongated shape, the connector assembly 102 may require a greater amount of force to disengage the wing member 148 from the latch element 222. However, in alternative embodiments, the latch opening 156 may have other shapes.

In some embodiments, the end portion 152 forms a lip 162 that extends in a rearward direction and away from the panel 104 when the connector assembly 102 is mounted thereto. As will be described in detail below, the lip 162 may engage the latch element 222 when the connector assembly 102 is moved in a locking direction. Alternatively, the end portion 152 does not include the lip 162, but may, for example, only form an edge of the planar section 154.

Optionally, the wing members 148 and 150 may include a fastener hole 158 formed through the planar section 154 and 160, respectively. The fastener holes 158 may align and cooperate with a fastener hole 206 and a panel notch 220 in the panel 104 to facilitate coupling the module 100 to the panel 104. As one example, the fastener holes 158 may be configured to receive a screw from the module 100. However, the fastener hole 158 may be configured to receive and engage other types of fasteners, such as clips, pins, plugs, and the like.

Also in FIG. 2, the panel 104 includes the cut-out 200 that is configured to receive and interface with the mating end 114. As shown, the cut-out 200 is one exemplary embodiment that may be used with the connector assembly 102. However, the cut-out 200 may be sized and/or shaped differently depending on the size, shape and various features of the mating end 114. As shown in the illustrated embodiment, the panel 104 includes a first, or front, side 202 that faces the exterior of the host system and a second, or rear, side 204 that faces the interior of the system.

The thickness T extends between the front and rear sides 202 and 204. The panel 104 may include other openings, such as the fastener hole 206, which are separate from the cut-out 200 but positioned relative to the cut-out 200.

Figure 3:
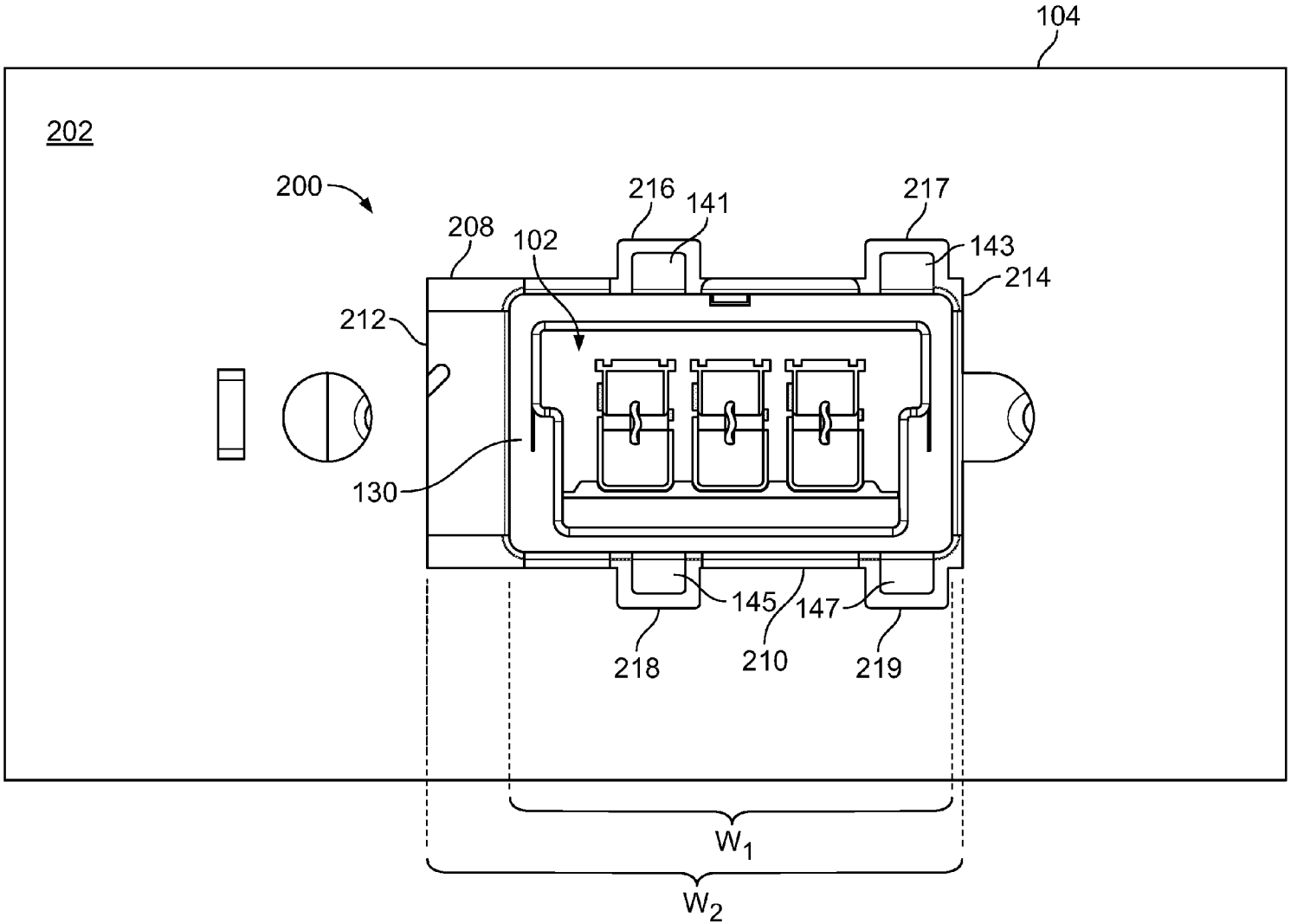
FIG. 3 is a front view of the connector assembly shown in FIG. 1 when the connector assembly is in an inserted position with respect to the panel.

FIG. 3 is a front view of the connector assembly 102 when the connector assembly is in the inserted position with respect to the panel 104. The cut-out 200 defines a window through which the front end 130 and/or parts of the frame 106 (FIG. 2) are inserted. More specifically the cut-out 200 has a shape that is similar to an outer perimeter formed by the front end 130 and tabs 141, 143, 145, and 147. With reference to both FIGS. 2 and 3, the cut-out 200 may have an upper edge 208 and a lower edge 210 that generally face the top side 120 and the bottom side 121, respectively, and may also have side edges 212 and 214 that generally face the opposing sides 122 and 123, respectively, when the connector assembly 102 is mounted to the panel 104. Although the side edges 208, 210, 212, and 214 completely surround and form a perimeter of the cut-out 200 in the illustrated embodiment, alternative embodiments may include the cut-out 200 extending from an edge of the panel 104 such that the cut-out 200 is not completely closed.

The upper edge 208 and the lower edge 210 are separated by a substantially similar distance as the height H of the connector assembly 102. However, in the exemplary embodiment, the side edges 212 and 214 are separated by a width $W_2$ (FIG. 3) that is greater than the width $W_1$ of the connector body 108. As such, the connector assembly 102 may be moved or transferred from side to side within the cut-out 200. Furthermore, the cut-out 200 may include a plurality of panel notches 216-220. As discussed above, the panel notch 220 may be used to facilitate coupling the module 100 (FIG. 1) to the panel 104 by receiving, for example, a screw. The notches 216 and 218 extend radially outward from edges 208 and 210, respectively, and diametrically oppose one another across the cut-out 200. Likewise, the notches 217 and 219 extend radially outward from edges 208 and 210, respectively, and diametrically oppose one another across the cut-out 200. Altogether, the notches 216-219 are arranged in a predetermined pattern that complements the perimeter of the mating end 114. Specifically, the notches 216-219 are sized and shaped to allow the tabs 141, 143, 145, and 147 to pass from the rear side 204 (FIG. 2) to the front side 202. When the tabs 141, 143, 145, and 147 are aligned with the notches 216-219, respectively, and the connector assembly 102 is moved in the mating direction, the tabs 141, 143, 145, and 147 and the front end 130 may advance through the cut-out 200 and into the inserted position.

FIG. 4 is a rear perspective view of the connector assembly 102 in the inserted position. With reference to FIGS. 3 and 4, when the connector assembly 102 is in the inserted position, inward facing surfaces of the tabs 141, 143, 145, and 147 (FIG. 3) face the front side 202 of the panel 104. As shown in FIG. 4, forward facing surfaces of the tabs 140, 142, 144, and 146 extend alongside and face the rear side 204. The wing members 148 and 150 extend alongside the rear side 204 of the panel 104. As shown, the end portion 152 of the wing member 148 is positioned adjacent to the latch element 222.

Figure 5:
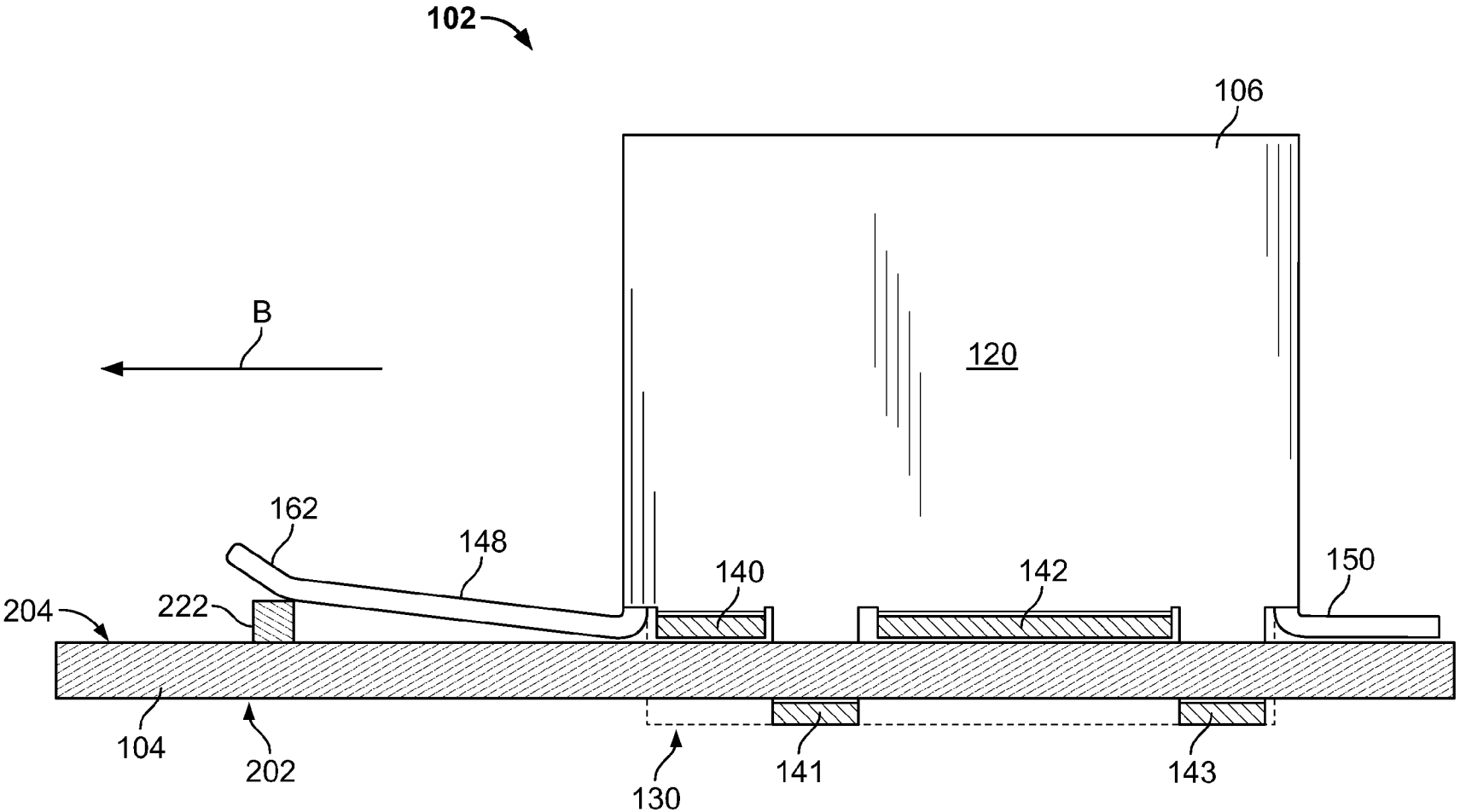
FIG. 5 is a top planar view of the connector assembly shown in FIG. 1 as the connector assembly is moved in a locking direction alongside the panel.
Figure 6:
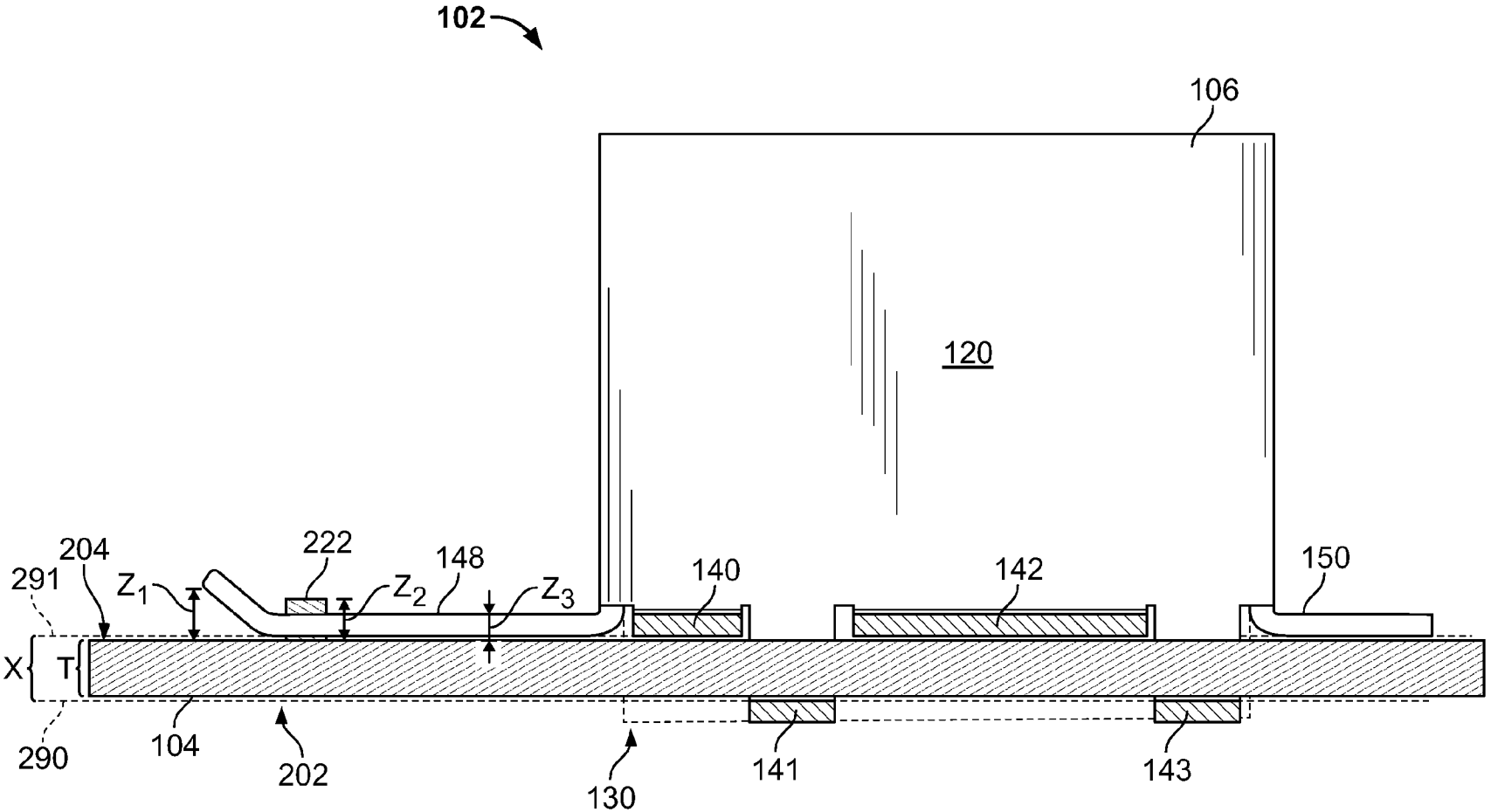
FIG. 6 is a top planar view of the connector assembly shown in FIG. 1 in a locked position with respect to the panel.

FIG. 5 is a top planar view of the connector assembly 102 while moving in the locking direction, indicated by the arrow B, alongside the panel 104. FIG. 6 is the top planar view of the connector assembly 102 when in the locked position. Although the following discussion is with respect to the top side 120 and the tabs 140-143, the description may similarly be applied to the bottom side 121 and the tabs 144-147. In the exemplary embodiment, the locking direction is substantially parallel to or moves along the horizontal axis 190 (shown in FIG. 2). However, in alternative embodiments, the connector assembly 102 and the panel 104 may be configured such that the locking direction may extend anywhere along an interface plane formed by the horizontal and vertical axes 190 and 191.

As shown in FIGS. 5 and 6, the frame 106 interfaces with both the front and rear sides 202 and 204 of the panel 104. In the exemplary embodiment, the rearward facing surfaces of the tabs 141 and 143 extend along a common exterior plane 290 (FIG. 6) that is adjacent to or directly abuts the front side 202. When the tabs 141 and 143 are inserted through the cut-out 200 (FIG. 2), the tabs 141 and 143 may clear the front side 202 of the panel 104 at substantially the same time. Furthermore, in the exemplary embodiment, the forward facing surfaces of the tabs 141 and 143 and of the wing members 148 and 150 extend along a common interior plane 291 (FIG. 6) that is adjacent to or directly abuts the rear side 204. The exterior and interior planes 290 and 291, respectively, may extend parallel to the interface plane formed by the horizontal and vertical axes 190 and 191 (FIG. 2). As shown in FIG. 6, the exterior and interior planes 290 and 291, respectively may extend parallel with respect to each other and be separated by an axial distance X. The axial distance X may represent the distance in which the interior tabs 140, 142, 144, and 146 are spaced apart from the exterior tabs 141, 143, 145, and 147 along the central axis 192 (FIG. 2). In the exemplary embodiment, the axial distance X is slightly greater than or substantially equal to the thickness T. As such, moving the connector assembly 102 in the locking direction may result in a minimal amount of frictional resistance.

However, in alternative embodiments, the distance X between the exterior and interior planes 290 and 291 may be slightly less than the thickness T. In embodiments where the distance X is slightly less than the thickness T, the tabs 140 and 142 and the wing members 148 and 150 are configured to flex backward thereby increasing the distance X between the exterior and interior planes 290 and 291 and allowing the tabs 141 and 143 to clear the front side 202 when inserted through the cut-out 200. As such, a friction fit may be formed between the tabs 141 and 143 and the tabs 140 and 142.

As shown in FIGS. 5 and 6, when the connector assembly 102 is moved in the locking direction, the forward facing surfaces of the wing members 148 and 150 and the tabs 140 and 142 move along the rear side 204. As the wing members 148 and 150 and the tabs 140 and 142 move along the rear side 204, the wing members 148 and 150 and the tabs 140 and 142 may be in slidable contact with the rear side 204. The lip 162 may contact or engage the latch element 222 causing the wing member 148 to flex outward with respect to the rear side 204. When the latch opening 156 clears the latch element 222, the wing member 148 resiles toward the rear side 204. In the locked position, the latch element 222 is received by and engaged with the latch opening 156.

When the lip 162 is in a flexed condition, the stored energy may push the connector assembly 102 rearward. In the exemplary embodiment, the panel 104 and the tabs 141 and 143 may be configured such that when the wing member 148 is in a flexed condition, the rearward facing surfaces of the tabs 141 and 143 have moved directly in front of a portion of the front side 202 of the panel 104. As such, the tabs 141 and 143 may prevent the connector assembly 102 from being pushed back into the plane of the cut-out 200.

As shown in FIG. 6, the lip 162 may project outward from the rear side 204 such that a distal end of the lip 162 is a distance $Z_1$ away from the rear side 204. The latch element 222 may project outward from the rear side 204 such that a distal end of the latch element 222 is a distance $Z_2$ away from the rear side 204. In the exemplary embodiment, the distance $Z_1$ is at least slightly greater than the $Z_2$, which forces the wing member 148 outward from the rear side 204 when the lip 162 engages the latch element 222. Furthermore, the lip 162 may be configured to allow a finger or tool to grip the lip 162 and force the lip 162 rearward in order to disengage the connector assembly 102. As such, the lip 162 may provide a release mechanism that is only accessible from the interior of the system.

Also shown, a rearward surface of the wing member 148 may be a distance $Z_3$ away from the rear side 204 of the panel 104. In one embodiment, the distance $Z_2$ is greater than the distance $Z_3$ such that the latch element 222 projects beyond the rearward surface of the wing member 148 when the wing member 148 is in the locked position.

Embodiments described herein include mountable electrical connector assemblies and frames that hold electrical connectors. In some embodiments, the connector assembly or the frame may provide a slide-and-lock type mounting mechanism that does not require additional hardware to attach the connector assembly or frame to a panel. Furthermore, the mounting mechanism may reduce the risk of the frame or connector assembly inadvertently disengaging from the panel by covering or hiding the release mechanism within an interior of a system. Also, the mounting mechanism may make the connector assembly and the frame easier to mount to a panel than known electrical connector assemblies.

Thus, it is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. For example, in one alternative embodiment, the connector assembly 102 is inserted through the cut-out 200 from the interior of the system. However, the wing member 148 is configured to advance through the cut-out 200 where the wing member 148 engages and slides along the front side 202 of the panel 104.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector assembly for mounting to a panel having a cut-out and a latch element projecting outward from a first side of the panel, the connector assembly being configured to move alongside the panel in a locking direction from an inserted position to a locked position, the connector assembly comprising:

a connector body having a mating end configured to interface with the panel and mate with another electrical connector through the cut-out;

at least one tab extending away from the body the tab being oriented to engage a second side of the panel when in the locked position; and a wing member extending away from the body and being oriented to move along the first side when moved in the locking direction, the wing member including an end portion and a latch opening configured to receive the latch element, wherein the wing member is configured to flex away from the first side when the end portion engages the latch element and resile toward the first side when the latch opening receives the latch element.

2. A connector assembly in accordance with claim 1 wherein the end portion includes a lip that projects at a non-orthogonal angle away from the first side, the lip being configured to engage the latch element when the wing member is moved in the locking direction.

3. A connector assembly in accordance with claim 1 wherein the tab is positioned forward of the wing member such that when the connector body is in the inserted position, the wing member is engaged with the first side and the tab has cleared the second side.

4. A connector assembly in accordance with claim 1 wherein the at least one tab includes a pair of co-planar tabs opposing each other across the cut-out.

5. A connector assembly in accordance with claim 1 wherein the panel includes a thickness extending between the first and second sides, the connector body extending along an axial direction, wherein the tab and the wing member are separated by a distance in the axial direction that is substantially equal to or greater than the thickness of the panel.

6. A connector assembly in accordance with claim 1 wherein the wing member includes a planar section that extends from the body to the end portion, the planar section including the latch opening and being oriented to abut the first side when in the locked position.

7. A connector assembly in accordance with claim 1 wherein the wing member is a first wing member and the connector assembly further comprises a second wing member extending away from the body and being oriented to slide along the first side when moved in the locking direction.

8. A connector assembly in accordance with claim 7 wherein the first and second wing members extend away from each other in opposing directions along a common plane, the first and second wing members being configured to engage the first side and stop movement of the connector body in an inserting direction.

9. A connector assembly in accordance with claim 1 further comprising a frame for surrounding and holding the connector body the tab and the wing member being coupled to and extending from the frame.

10. A connector assembly in accordance with claim 1 wherein the connector body includes a plurality of sides extending parallel with respect to each other, the tab and the wing member extending away from the body from different sides.

11. A frame for holding an electrical connector body the frame extending along a longitudinal axis and being configured to mount to a panel, the panel having a cut-out and a latch element projecting outward from a first side of the panel, the frame configured to move along the panel in a locking direction from an inserted position to a locked position, the frame comprising:

a mating end configured to interface with the panel when mounted thereto;

at least one tab extending away from the longitudinal axis, the tab being oriented to engage a second side of the panel when in the locked position; and a wing member extending away from the longitudinal axis and being oriented to move along the first side when moved in the locking direction, the wing member including an end portion and a latch opening configured to receive the latch element, wherein the wing member is configured to flex away from the first side when the end portion engages the latch element and resile toward the first side when the latch opening receives the latch element.

12. A frame in accordance with claim 11 wherein the end portion includes a lip that projects at a non-orthogonal angle away from the first side, the lip being configured to engage the latch element when the wing member is moved in the locking direction.

13. A frame in accordance with claim 11 wherein the tab is positioned forward of the wing member such that the tab has cleared the second side when the wing member is engaged with the first side.

14. A frame in accordance with claim 11 wherein at least one tab includes a pair of co-planar tabs opposing each other across the cut-out of the panel.

15. A frame in accordance with claim 11 wherein the panel includes a thickness extending between the first and second sides, wherein the tab and the wing member are separated by a distance in the axial direction that is substantially equal to or greater than the thickness of the panel.

16. A frame in accordance with claim 11 wherein the wing member includes a planar section that extends from the mating end to the end portion, the planar section including the latch opening and being oriented to abut the first side when in the locked position.

17. A frame in accordance with claim 11 wherein the wing member is a first wing member and the frame further comprises a second wing member extending away from the longitudinal axis and being oriented to slide along the first side when moved in the locking direction.

18. A frame in accordance with claim 17 wherein the first and second wing members extend away from each other in opposing directions along a common plane, the first and second wing members being configured to engage the first side and stop movement of the frame in an inserting direction.

19. A frame in accordance with claim 11 wherein the frame is stamped and formed from sheet metal.

20. A frame in accordance with claim 11 wherein the mating end includes a front edge, the tab and the wing member coupled to an extending from the front edge.

* * * * *